US009954273B2

(12) United States Patent
Shiu et al.

(10) Patent No.: US 9,954,273 B2
(45) Date of Patent: Apr. 24, 2018

(54) ELECTRONIC DEVICE ANTENNAS WITH LASER-ACTIVATED PLASTIC AND FOAM CARRIERS

(71) Applicant: Apple Inc., Cupertino, CA (US)

(72) Inventors: Boon W. Shiu, San Jose, CA (US); Chun-Lung Chen, Sunnyvale, CA (US); Erdinc Irci, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 189 days.

(21) Appl. No.: 14/676,424

(22) Filed: Apr. 1, 2015

(65) Prior Publication Data

US 2016/0294045 A1 Oct. 6, 2016

(51) Int. Cl.
*H01Q 1/38* (2006.01)
*H01Q 1/24* (2006.01)
*H01Q 9/42* (2006.01)

(52) U.S. Cl.
CPC ..... *H01Q 1/38* (2013.01); *H01Q 1/243* (2013.01); *H01Q 9/42* (2013.01)

(58) Field of Classification Search
CPC ..... H01Q 1/243; H01Q 1/38
See application file for complete search history.

(56) References Cited

U.S. PATENT DOCUMENTS 5,733,639 A * 3/1998 Gosselin ..... B32B 5/18 174/256
6,947,008 B2 9/2005 Tillery et al.
8,730,124 B2 5/2014 Behrens et al.
2005/0123857 A1* 6/2005 Luch ..... H01Q 1/22 430/311
2009/0174612 A1* 7/2009 Ayala ..... H01Q 1/2266 343/702
2013/0082895 A1 4/2013 Shiu et al.
2013/0088406 A1 4/2013 Hamada et al.
2013/0190607 A1 7/2013 Biber et al.
2013/0249740 A1* 9/2013 Shedletsky ..... H01Q 1/38 343/700 MS
2013/0300618 A1* 11/2013 Yarga ..... H01Q 1/243 343/720

(Continued)

FOREIGN PATENT DOCUMENTS

WO WO2004070878 A1 8/2004

*Primary Examiner* — Daniel J Munoz
(74) *Attorney, Agent, or Firm* — Treyz Law Group, P.C.; G. Victor Treyz; Tianyi He

(57) ABSTRACT

An electronic device may be provided with wireless circuitry that includes antennas. An antenna may be formed from metal traces on a dielectric antenna carrier. The antenna carrier may be formed by molding a layer of plastic onto the surface of a foam member. The foam member may have a low dielectric constant to enhance antenna performance and may be formed from a stiff closed cell plastic foam material. Heat and pressure may be used to attach the layer of plastic to the surface of the foam member without adhesive. A laser may be used to selectively expose portions of the plastic layer to laser light. The plastic layer may include additives that sensitize the plastic layer to light exposure. Electroplated metal traces for the antenna may be formed on the exposed portions of the plastic layer while leaving other portions of the plastic layer uncovered with metal.

20 Claims, 17 Drawing Sheets

(56) References Cited

U.S. PATENT DOCUMENTS

| | | | | |
|---|---|---|---|---|
| 2013/0321988 | A1* | 12/2013 | Ho | H05K 13/0046 361/679.01 |
| 2013/0335275 | A1 | 12/2013 | Sanford et al. | |
| 2014/0226291 | A1 | 8/2014 | Gibbs et al. | |
| 2014/0306845 | A1 | 10/2014 | Shiu et al. | |

* cited by examiner

ELECTRONIC DEVICE ANTENNAS WITH LASER-ACTIVATED PLASTIC AND FOAM CARRIERS

BACKGROUND

This relates generally to electronic devices and, more particularly, to electronic devices with antennas.

Electronic devices often include antennas. For example, cellular telephones, computers, and other devices often contain antennas for supporting wireless communications.

It can be challenging to form electronic device antenna structures with desired attributes. In some wireless devices, the presence of conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved antennas for electronic devices.

SUMMARY

An electronic device may be provided with wireless circuitry that includes antennas. An antenna may be formed from metal traces on a dielectric antenna carrier. The antenna carrier may be formed by molding a layer of plastic onto the surface of a foam member. The foam member may have a low dielectric constant to enhance antenna performance and may be formed from a stiff closed cell plastic foam material.

Heat and pressure may be used to attach the layer of plastic to the surface of the foam member without adhesive. A laser may be used to selectively expose portions of the plastic layer to laser light. The plastic layer may include additives that sensitize the plastic layer to light exposure. Electroplated metal traces for the antenna may be formed on the exposed portions of the plastic layer while leaving other portions of the plastic layer uncovered with metal.

The foam member may be molded into a shape that forms a housing frame, a display chassis, or other structural member in an electronic device. Cables and other structures may pass through interior cavities in the foam member. The foam member may be molded into a shape with undulations or other recesses. Antenna size may be minimized in configurations in which the metal traces run over the undulations.

DETAILED DESCRIPTION

Figure 1:
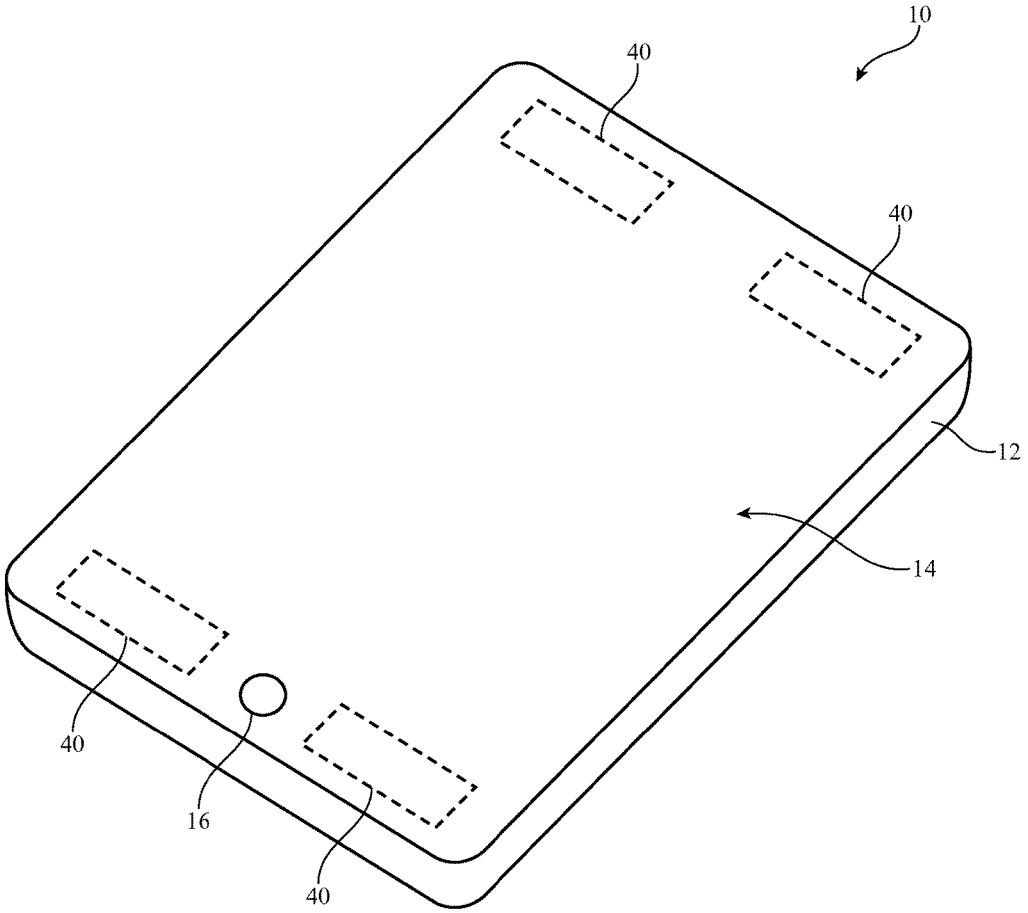
FIG. 1 is a perspective view of an illustrative electronic device with wireless communications circuitry in accordance with an embodiment.

An electronic device such as electronic device 10 of FIG. 1 may contain wireless circuitry. The wireless circuitry may include antenna structures such as antennas with metal traces supported by dielectric antenna carriers. The antenna carriers may have foam covered with a layer of plastic. The plastic may be a sheet of plastic that is suitable for selective laser activation. Following exposure to laser light in selected areas, metal traces can be formed on the exposed areas of the plastic layer using electroplating techniques (i.e., electroless plating).

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

In the example of FIG. 1, device 10 includes a display such as display 14. Display 14 has been mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of pixels formed from liquid crystal display (LCD) components, an array of electrophoretic pixels, an array of plasma pixels, an array of organic light-emitting diode pixels, an array of electrowetting pixels, or pixels based on other display technologies.

Display 14 may be protected using a display cover layer such as a layer of transparent glass or clear plastic. Openings may be formed in the display cover layer. For example, an opening may be formed in the display cover layer to accommodate a button such as button 16. An opening may also be formed in the display cover layer to accommodate ports such as a speaker port. Openings may be formed in housing 12 to form communications ports (e.g., an audio jack port, a digital data port, etc.). Openings in housing 12 may also be formed for audio components such as a speaker and/or a microphone.

Antennas may be mounted in housing 12. For example, housing 12 may have four peripheral edges as shown in FIG. 1 and one or more antennas 40 may be mounted along the edges of housing 12, at the corners of housing 12 (as shown in FIG. 1) or elsewhere in device 10. Antennas 40 may be mounted under dielectric antenna windows in a metal housing, under portions of display 14, within a plastic device housing, or at other suitable locations within device 10. There may be any suitable number of antennas 40 in device 10 (e.g., one antenna, two antennas, three antennas, or four or more antennas).

Figure 2:
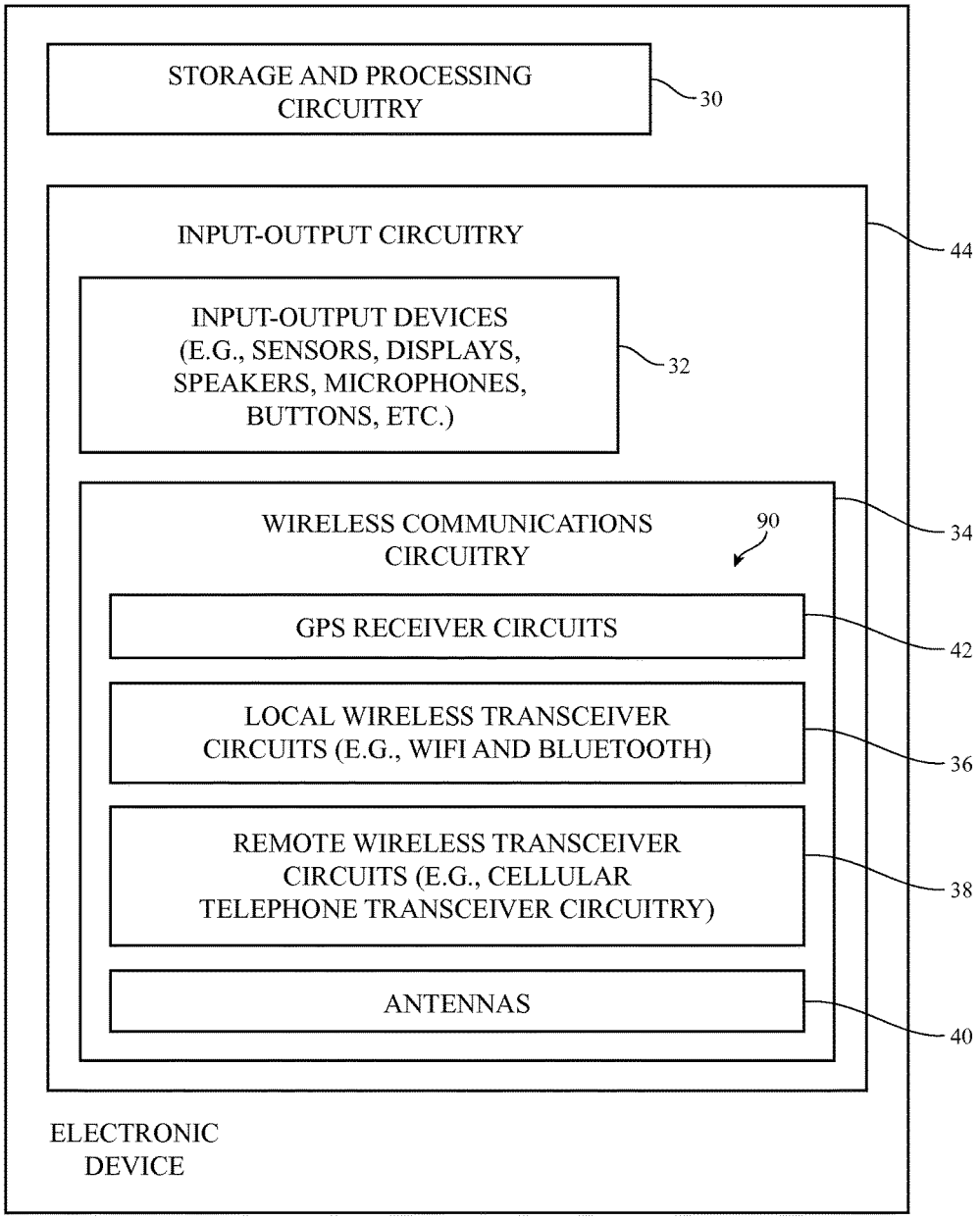
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include control circuitry such as storage and processing circuitry 30. Storage and processing circuitry 30 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 30 may be used to control the operation of device 10. This processing circuitry may be based on one or more microprocessors, microcontrollers, digital signal processors, baseband processor integrated circuits, application specific integrated circuits, etc.

Storage and processing circuitry 30 may be used to run software on device 10, such as internet browsing applications, voice-over-internet-protocol (VOIP) telephone call applications, email applications, media playback applications, operating system functions, etc. To support interactions with external equipment, storage and processing circuitry 30 may be used in implementing communications protocols. Communications protocols that may be implemented using storage and processing circuitry 30 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, satellite navigation system protocols, etc.

Device 10 may include input-output circuitry 44. Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, a connector port sensor or other sensor that determines whether device 10 is mounted in a dock, and other sensors and input-output components.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42.

Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band.

Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data.

Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc.

Wireless communications circuitry 34 may include satellite navigation system circuitry such as global positioning system (GPS) receiver circuitry 42 for receiving GPS signals at 1575 MHz or for handling other satellite positioning data (e.g., GLONASS signals at 1609 MHz). In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Antennas 40 in wireless communications circuitry 34 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. If desired, one or more of antennas 40 may be cavity-backed antennas formed by placing slot antennas, monopole antennas, and other resonating element structures over the opening in a metal antenna cavity. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals).

Transmission line paths may be used to couple antenna structures 40 to transceiver circuitry 90. Transmission lines in device 10 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within the transmission lines, if desired.

Device 10 may contain multiple antennas 40. The antennas may be used together or one of the antennas may be switched into use while the other antenna(s) may be switched out of use. If desired, control circuitry 30 may be used to select an optimum antenna to use in device 10 in real time and/or an optimum setting for a phase shifter or other wireless circuitry coupled to the antennas (e.g., an optimum antenna to receive satellite navigation system signals, etc.). Control circuitry 30 may, for example, make an antenna selection or antenna array phase adjustment based on information on received signal strength, based on sensor data (e.g., orientation information from an accelerometer), based on other sensor information (e.g., information indicating whether device 10 has been mounted in a dock in a portrait orientation), or based on other information about the operation of device 10.

Figure 3:
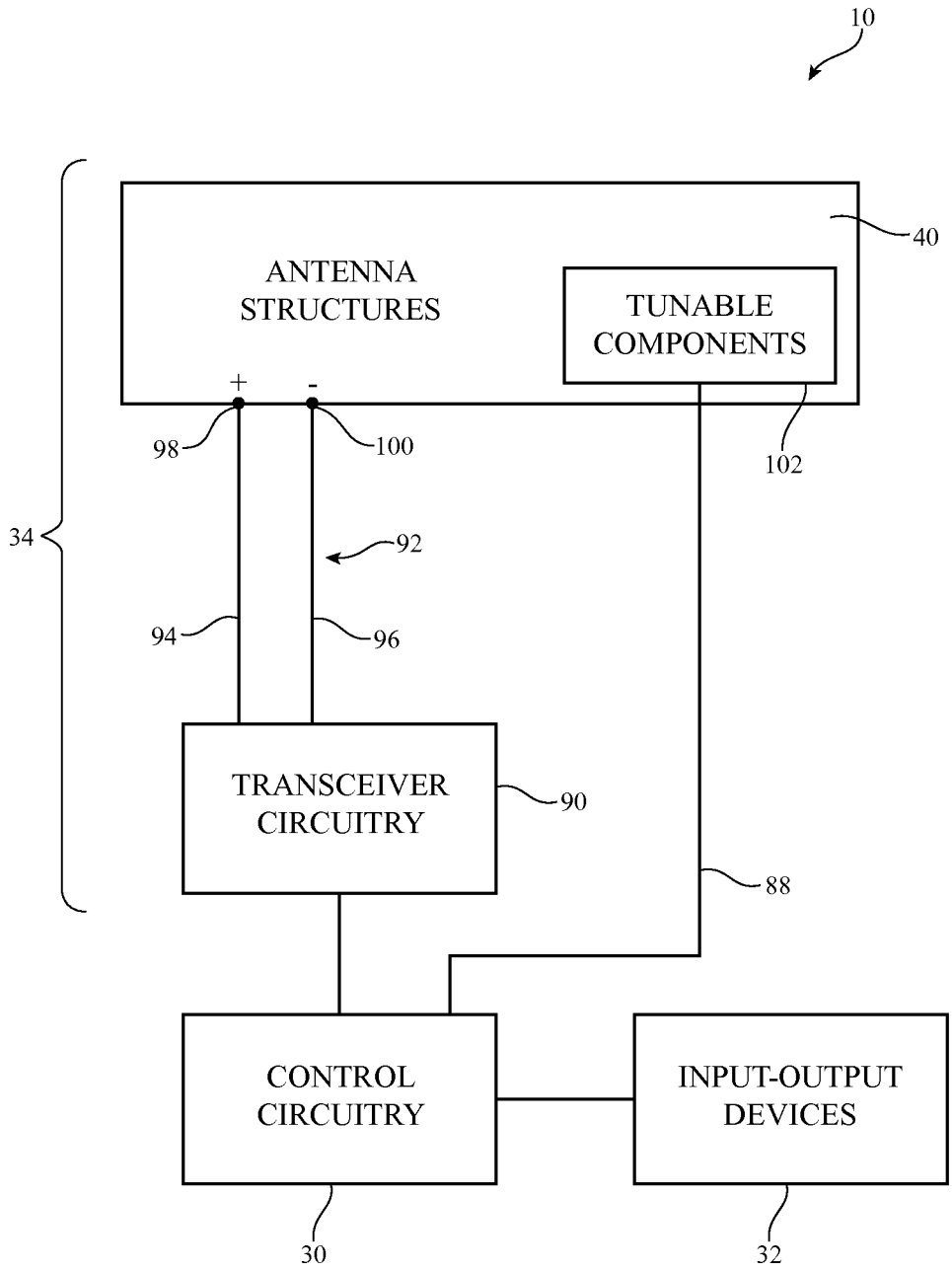
FIG. 3 is a diagram of illustrative wireless circuitry in accordance with an embodiment.

As shown in FIG. 3, transceiver circuitry 90 in wireless circuitry 34 may be coupled to antenna structures 40 using paths such as transmission line path 92. Wireless circuitry 34 may be coupled to control circuitry 30. Control circuitry 30 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 40 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 30 may issue control signals on one or more paths such as path 88 that adjust inductance values, capacitance values, or other parameters associated with tunable components 102, thereby tuning antenna structures 40 to cover desired communications bands. Configurations in which antennas 40 are fixed (not tunable) may also be used.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable or a microstrip transmission line on a printed circuit (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna structures 40.

Transmission line 92 may be coupled to antenna feed structures associated with antenna structures 40. As an example, antenna structures 40 may form an inverted-F antenna, a slot antenna, a hybrid inverted-F slot antenna, a monopole antenna, an antenna having a parasitic antenna resonating element, or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. The illustrative feeding configuration of FIG. 3 is merely illustrative.

It may be desirable to form one or more of antennas 40 using foam carriers. The foam in a foam antenna carrier may be formed from a dielectric material that has a low dielectric constant (e.g., a polymer foam material such as a plastic that incorporates air bubbles or other voids), thereby enhancing antenna performance. The dielectric constant of the foam may be, for example, less than 1.4, less than 1.3, less than 1.25, 1.05-1.25, less than 1.2, 1.1-1.2, more than 1.05, or any other suitable value.

Figure 4:
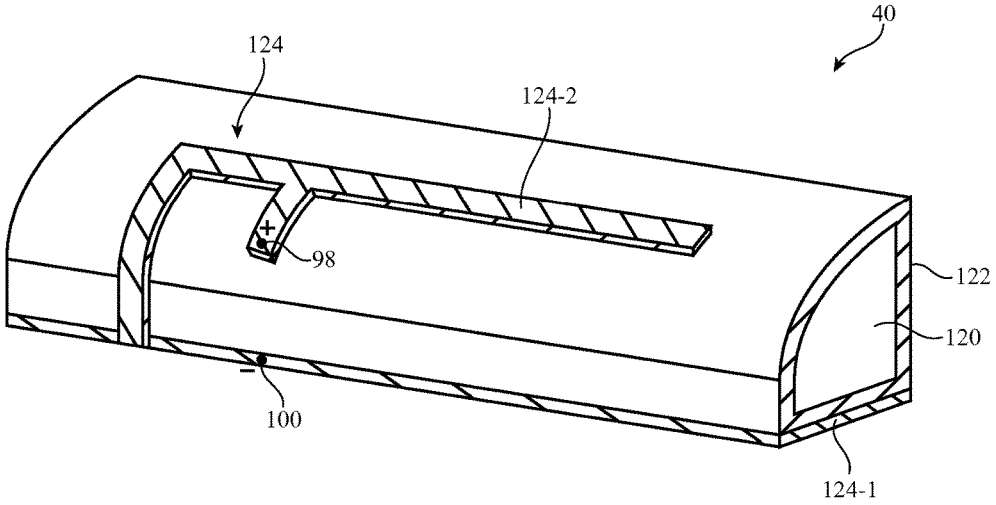
FIG. 4 is a perspective view of an illustrative antenna formed on a foam carrier covered with a plastic sheet in accordance with an embodiment.

A perspective view of an illustrative antenna formed using a foam antenna carrier is shown in FIG. 4. As shown in FIG. 4, antenna 40 may be supported by an elongated foam core structure such as foam member 120. Foam member 120 may be formed from a stiff acrylic closed cell foam with a high temperature resistance (e.g., an ability to withstand damage at an applied temperature of 220° C. or more, 200° C. or more, etc.) such as the Rohacell® foam available from Evonik industries of Essen, Germany. Other plastic foams may be used if desired.

Stiff foam is desirable for foam 120 because it helps antenna 40 hold its shape during use in device 10 so that the performance of antenna 40 is stable. High temperature resistance in foam 120 allows cables, metal structures in flexible printed circuits, and other conductive transmission line structures or signal lines to be mounted to antenna 40 using solder (e.g., a solder reflow process, hot-bar soldering techniques, etc.). Low dielectric constant foams help enhance antenna performance by minimizing power loss. If desired, foam structure 120 may be formed from a flexible foam, a low temperature foam, etc. The use of a stiff high temperature foam with a low dielectric constant is merely illustrative.

Antenna 40 may include metal structures such as metal traces 124 for forming an antenna resonating element such as antenna resonating element 124-2 and antenna ground 124-1. Metal structures such as traces 124 may be formed directly on foam 120 or traces 124 may be formed on a layer of dielectric such as dielectric layer 122 that is attached to the some or all of the surfaces of foam 120.

With one suitable arrangement, layer 122 is a layer of laser direct structuring (LDS) plastic and metal traces 124 are formed using laser direct structuring (LDS) techniques. With laser direct structuring techniques, a metal complex or other additive may be incorporated into the plastic material that forms plastic layer 122 to ensure that plastic layer 122 can be activated by light exposure. Plastic layer 122 may be formed from a plastic material such as polycarbonate (PC), acrylonitrile butadiene styrene (ABS), a PC/ABS blend, or other plastics (as examples). Upon exposure to laser light in particular areas, the exposed areas of the surface of layer 122 become sensitized for subsequent metal growth (e.g., metal growth during metal electroplating using electroless deposition techniques). During metal growth operations following selective surface activation with laser light, electroplated metal 124 (i.e., electrolessly deposited metal) will grow only in the activated areas exposed to the laser light. The thickness of plastic 122 may be about 0.1-1 mm, less than 0.8 mm, less than 0.6 mm, less than 0.5 mm, less than 0.3 mm, less than 0.2 mm, more than 0.05 mm, more than 0.1 mm, 0.1-0.5 mm, 0.05-0.5 mm, or other suitable thickness. The dielectric constant of layer 122 may be about 2.7-3, may be less than 3.5, may be more than 2, may be 1.8-3.1, or may have any other suitable value. Layer 122 may be attached to layer 120 using lamination techniques (e.g., application of heat and pressure in a mold), adhesive, or other suitable techniques.

The addition of LDS plastic layer 122 onto the surface of foam structure 120 facilitates the formation of laser-patterned metal traces 124 for antenna 40 on the surface of the dielectric carrier formed from foam 120 and plastic layer 122. By using laser direct structuring to pattern metal onto the surface of layer 122 and foam to form a supporting core structure such as structure 120, the antenna carrier for antenna 40 may incorporate potentially complex shapes. As an example, foam 120 and layer 122 may form shapes that are hollow, may include grooves or other recesses, may have bends, may have planar surfaces and/or curved surfaces, or may have other suitable shapes.

In the illustrative configuration of FIG. 4, foam 120 has an elongated shape with a curved surface that supports trace 124-2 and a planar surface that supports trace 124-1. This is merely an example. Foam 120 and plastic layer 122 may have any suitable shape and metal traces 124 for antenna 40 may have any suitable shape. Moreover, additional conductive structures (e.g., portions of housing 12, etc.) may, if desired, form portions of antenna 40 (e.g., portions of an antenna ground, portions of a resonating element, etc.).

Figure 5:
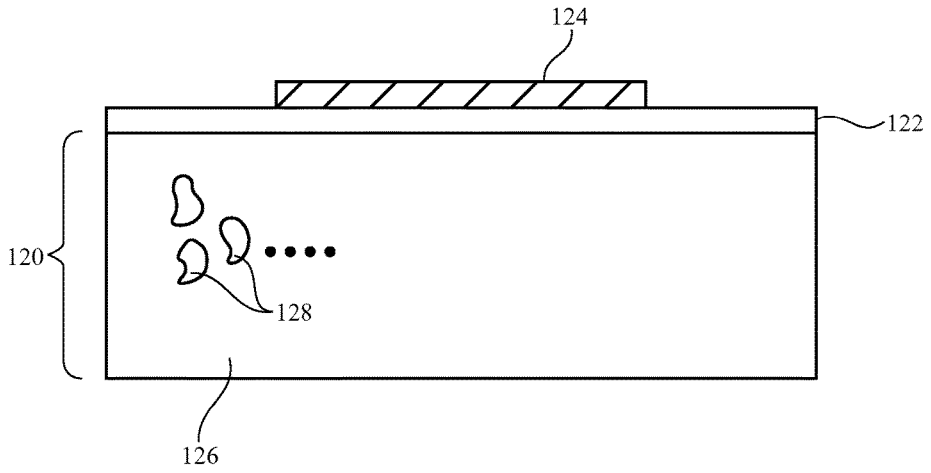
FIG. 5 is cross-sectional side view of an illustrative antenna formed on a foam carrier covered with a plastic sheet in accordance with an embodiment.

FIG. 5 is a cross-sectional side view of an illustrative antenna formed using foam 120, LDS plastic layer 122, and electroplated metal traces 124 formed on laser-activated areas of layer 122. As shown in FIG. 5, foam 120 may include plastic material 126 that is filled with voids 128 (e.g., air-filled holes, bubbles of gasses other than air, etc.).

Figure 6:
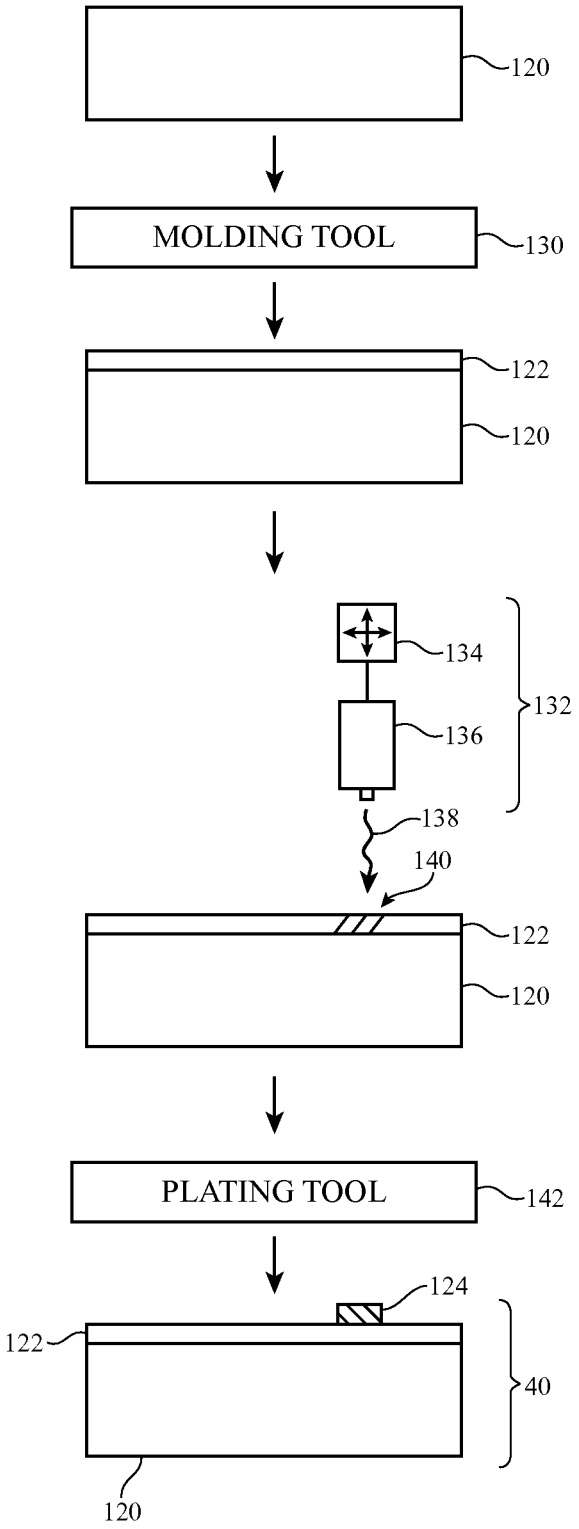
FIG. 6 is a diagram of illustrative equipment and operations involved in forming an antenna in accordance with an embodiment.

Illustrative equipment and fabrication techniques of the type that may be used in forming antenna 40 are shown in FIG. 6. As shown in FIG. 6, molding tool 130 may be used to laminate plastic layer 122 to the outer surface of foam 120. Molding tool 130 may include a heat source such as a lamp or heated metal die. When layer 122 is heated and compressed against foam 120 by molding tool 130, layer 122 will become attached to foam 120 as shown in FIG. 6. The plastic of layer 122 will adhere to the plastic of foam structure 120 when heated and compressed without using any intervening adhesive, although a layer of adhesive may be used, if desired. Foam 120 may also be formed into a desired shape during the process of molding foam 120 and layer 122 with tool 130. Metal traces 124 may be patterned onto layer 122 before or after molding layer 122 to foam 120. In the illustrative arrangement of FIG. 6, laser patterning operations are performed after layer 122 has been attached to foam 120.

As shown in FIG. 6, laser patterning tool 132 includes laser 136. Laser 136 emits laser beam 138. Laser 136 may be an infrared laser, a visible light laser, or an ultraviolet light laser. Laser 136 may be a pulsed laser or a continuous wave laser. The position of the laser light in beam 138 relative to the surface of plastic layer 122 may be controlled using computer-controlled laser positioner 134 and/or a positioner that adjusts the position of foam 120 and layer 122 relative to a stationary or moving laser.

After selectively exposing portions of the surface of layer 122 to laser light 138 such as illustrative exposed area 140 of FIG. 6, plating tool 142 may be used to selectively electroplate metal onto the surface of layer 120 in exposed area 140, thereby forming laser-patterned metal traces 124 for antenna 40.

Figure 7:
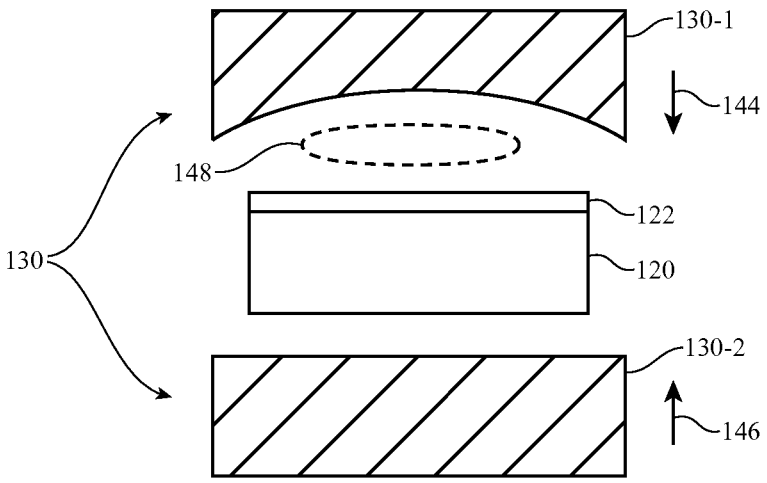
FIG. 7 is a cross-sectional side view of an illustrative molding tool that is being used to form a foam antenna carrier in accordance with an embodiment.
Figure 8:
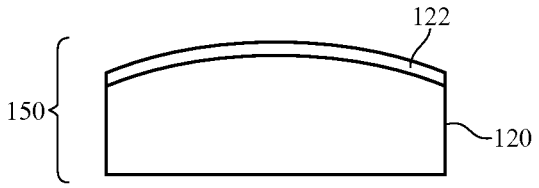
FIG. 8 is a cross-sectional side view of an illustrative antenna carrier formed using a molding tool of the type shown in FIG. 7 in accordance with an embodiment.
Figure 9:
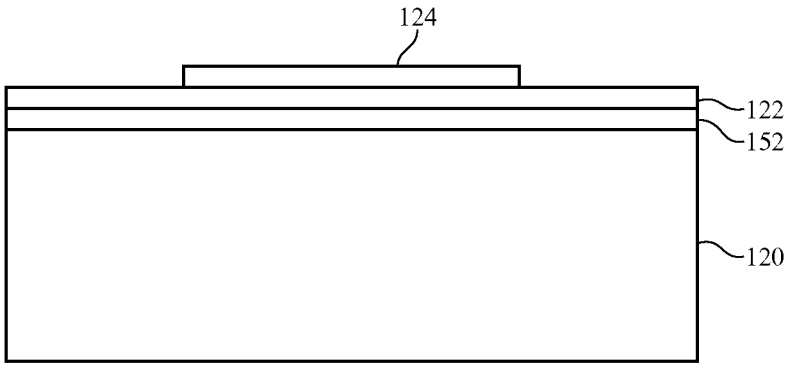
FIG. 9 is a cross-sectional side view of an illustrative antenna formed on a carrier having multiple dielectric layers attached to the surface of a foam structure in accordance with an embodiment.

FIG. 7 is a cross-sectional side view of an illustrative molding tool having an upper die such as die 130-1 and a lower die such as die 130-2. Die 130-1 and die 130-2 may be heated to heat layer 122 and foam 120 during molding and/or heat may be applied to layer 122 and 120 using heat sources such as heat lamp 148. When it is desired to mold layer 122 and foam 120 into a desired shape, die 130-1 may be moved in direction 144 and die 130-2 may be moved in direction 146, thereby sandwiching layers 120 and 122 between die 130-1 and 130-2. Using this type of process, desired antenna carrier shapes may be formed (see, e.g., illustrative antenna carrier 150 of FIG. 8).

If desired, the outer surface of foam 120 may be covered with multiple layers of dielectric material. As shown in FIG.

9, for example, a structural layer such as layer 152 (e.g., a layer of carbon fiber material, other fiber-filled plastic materials, other plastics, dielectrics other than plastic, etc.) may be interposed between layer 122 and foam 120 to add additional strength to antenna 40 and/or to otherwise enhance the mechanical and electrical properties of antenna 40.

Figure 10:
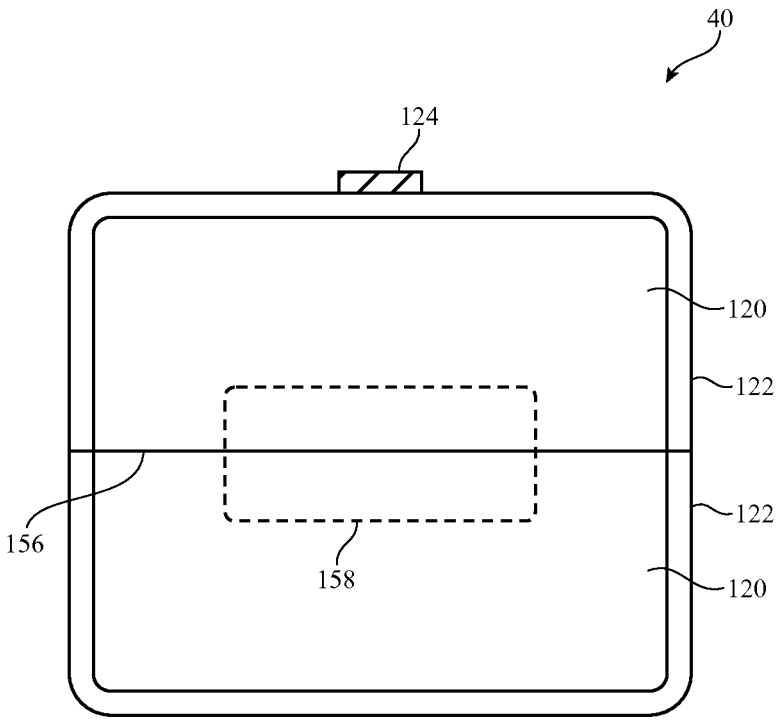
FIG. 10 is a cross-sectional side view of an illustrative antenna carrier having a sheet of plastic that has been molded around the upper and lower surfaces of a foam structure in accordance with an embodiment.

FIG. 10 is a cross-sectional side view of an illustrative configuration for antenna 40 in which layer 122 has been used to cover the opposing upper and lower surfaces of foam 120 and the sides of foam 120 (e.g., so that layer 122 runs around the entire cross-sectional periphery of foam member 120). Metal traces 124 may be formed on the top, bottom, sides, or other surfaces of layer 122. Structures of the type shown in FIG. 10 may be formed by molding together upper and lower halves of foam 120 and corresponding plastic sheets 122. If desired, the interior of foam 120 may be hollow (see, e.g., optional hollow portion 158). Hollow portion 158 may be formed by placing a portion of a molding tool within foam 120 during molding. The inclusion of hollow portion 158 may help reduce the effective dielectric constant of the antenna carrier. If desired, foam structure 120 may be formed from a pair of joined foam structures (e.g., foam that is joined along seam 156 before or after molding).

Figure 11:
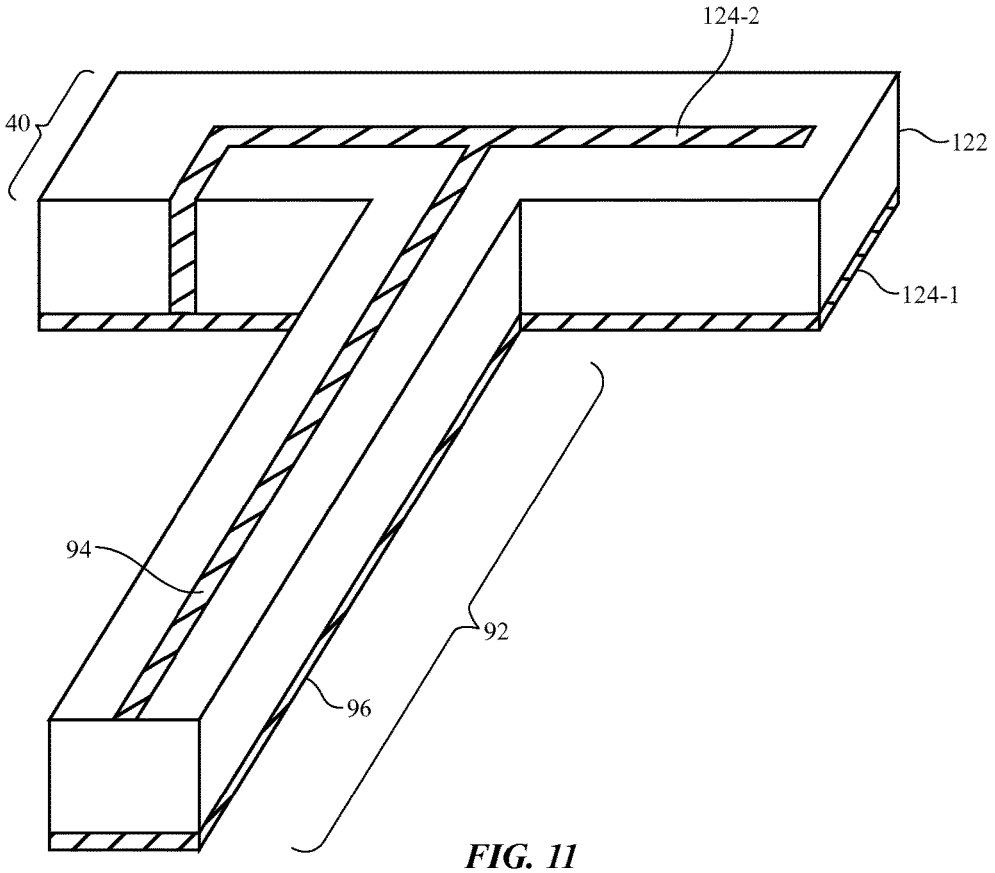
FIG. 11 is a perspective view of an illustrative antenna formed from a foam carrier that has an integrated transmission line portion in accordance with an embodiment.

FIG. 11 shows how foam 120 (i.e., foam that underlies the exposed plastic of layer 122 in FIG. 11), metal 124, and layer 122 may be patterned to form a transmission line such as transmission line 92 that feeds an antenna such as antenna 40. Antenna 40 and transmission line 92 may be formed from portions of the same foam and plastic carrier structure. Metal traces 124-1 may form an antenna ground in antenna 40 and metal traces 124-2 may form an antenna resonating element in antenna 40 (as an example). In transmission line 92, portions of traces 124-2 may form positive signal path 94 and portions of traces 124-1 may form ground signal path 96.

Figure 12:
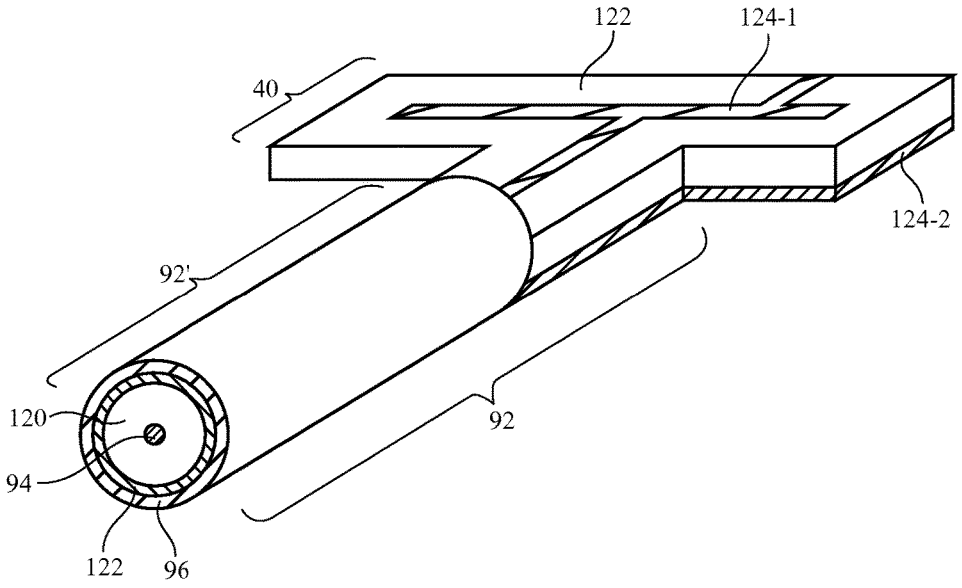
FIG. 12 is a perspective view of another illustrative antenna formed from a foam carrier that has an integrated transmission line portion in accordance with an embodiment.

In the example of FIG. 12, transmission line structure portion 92' of transmission line 92 has been formed from foam 120 that has been coated with plastic layer 122. A metal trace on layer 122 (e.g., a laser-patterned metal trace) may be used in forming outer ground conductor 96 of transmission line portion 92' Inner conductor 94 may be formed from a length of wire, metal traces on an embedded LDS plastic layer, patterned metal foil, or other metal. Portion 92' may have a circular cross-sectional shape or other suitable shape.

Figure 13:
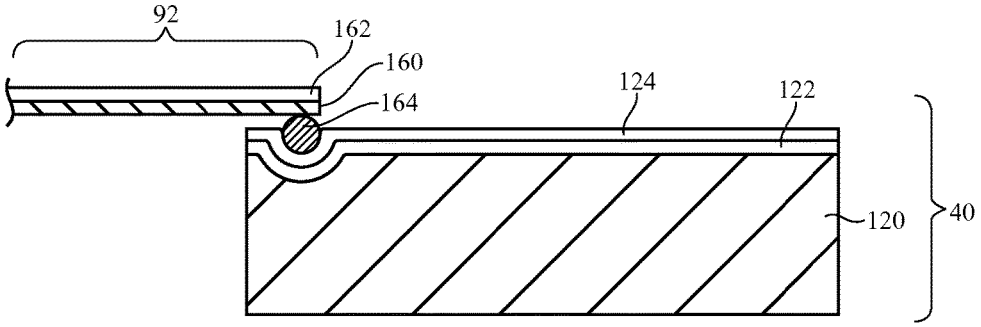
FIG. 13 is a cross-sectional side view of an illustrative antenna formed on a foam member with a plastic layer in which metal traces on the plastic layer have been soldered to conductors in a transmission line in accordance with an embodiment.

If desired, a cable such as a coaxial cable or printed circuit that forms a transmission line may be soldered to antenna 40. This type of arrangement is shown in the cross-sectional side view of antenna 40 and transmission line 92 of FIG. 13. As shown in FIG. 13, transmission line (printed circuit) 92 may include a substrate such as substrate 162 (e.g., a rigid printed circuit board substrate formed from a rigid printed circuit board material such as fiberglass-filled epoxy or a flexible printed circuit substrate formed from a flexible sheet of polyimide or other flexible layer of polymer). Positive signal traces and ground signal traces may be formed on substrate 162 (see, e.g., illustrative metal trace 160). Conductive transmission line structures such as metal trace 160 may be soldered to metal trace 124 in antenna 40 using solder 164. If desired, electrical connections between the positive and ground traces of transmission line 92 may be formed with metal traces 124 on antenna 40 using conductive adhesive, welds, crimped connections, or other connections.

Figure 14:
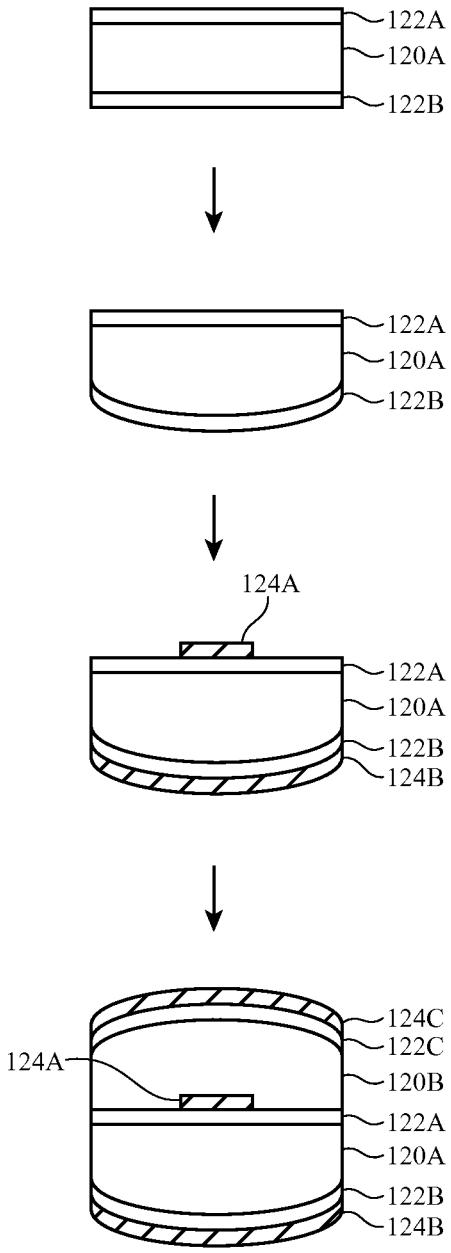
FIG. 14 is a diagram of illustrative operations involved in forming a transmission line or antenna with an embedded conductive line in accordance with an embodiment.

FIG. 14 shows how signal lines may be embedded within foam 120. As shown in FIG. 14, LDS plastic layers 122A and 122B may be placed on the upper and lower surfaces of foam 120A and molded under heat and pressure to form a planar upper surface layer 122A and a curved lower surface layer 122B. Metal trace 124A (e.g., a positive signal line for a transmission line) may then be patterned on the top of layer 122A and metal traces 124B (e.g., part of a ground signal lines for a transmission line) may be patterned on layer 122B using laser direct structuring techniques. Following patterning of metal traces 124A and 124B, foam layer 120B, LDS plastic layer 122C, and laser-patterned metal trace 124C (e.g., another part of the ground signal path for the transmission line) may be formed on top of metal trace 124A and layer 122A. The completed structures of FIG. 14 may be used to form a transmission line (e.g., transmission line 92) or other suitable structures (e.g., parts of antenna 40, etc.).

Figure 15:
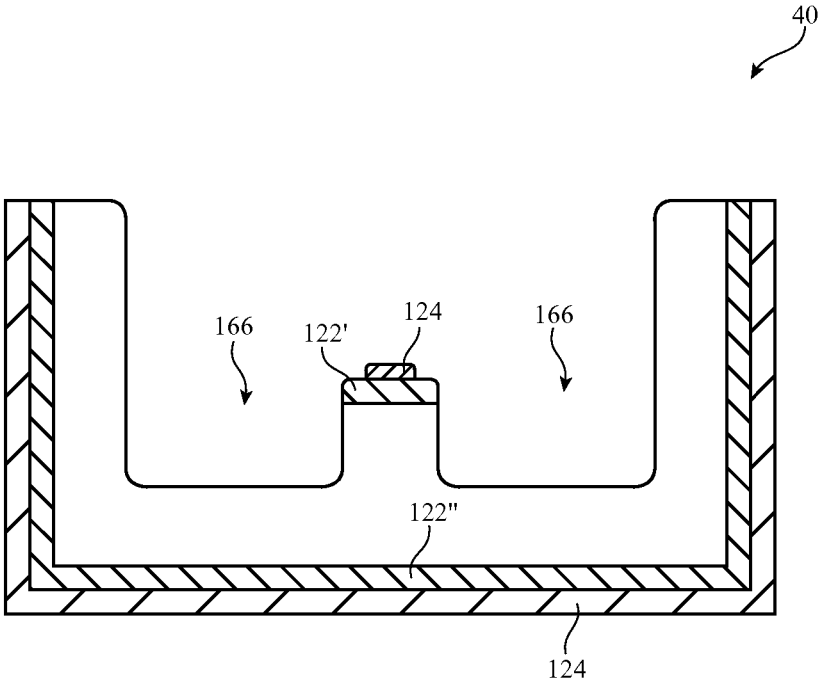
FIG. 15 is a cross-sectional side view of an illustrative molded foam structure for an antenna having grooves or other recesses in accordance with an embodiment.

As shown in the cross-sectional side view of FIG. 15, LDS plastic layers such as layers 122' and 122" and foam 120 may be provided with recesses 166 and this recessed antenna carrier structure may be provided with metal traces 124 to form antenna 40 (e.g., a cavity antenna or other antenna).

Figure 16:
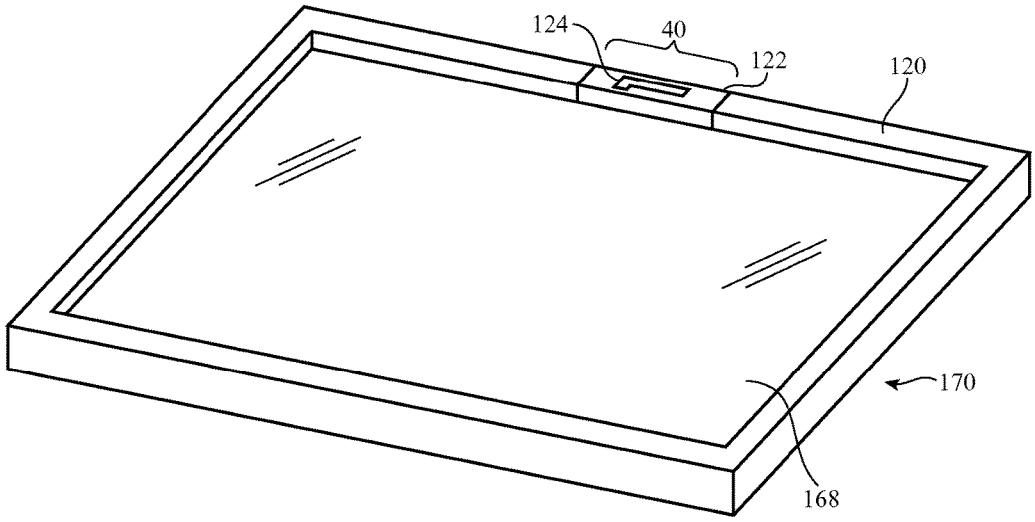
FIG. 16 is a perspective view of an illustrative foam housing frame with a portion that has been covered with a sheet of plastic and electroplated metal traces on laser-exposed portions of the sheet of plastic to form an antenna in accordance with an embodiment.

In the illustrative configuration of FIG. 16, foam 120 has been used to form rectangular structure 170. Structure 170 may have a recess that receives structures 168. Structures 168 may be layers of display 14 and structure 170 may be a display chassis or housing frame (as examples). Plastic layer 122 may be formed over a portion of foam 120 and laser-patterned metal traces 124 for antenna 40 may be formed on layer 122. Portions of foam 120 may remain uncovered by layer 122. There is one antenna in the configuration of FIG. 16, but multiple antennas may be formed from different segments of the rectangular foam ring structure formed from foam 120, if desired.

Figure 17:
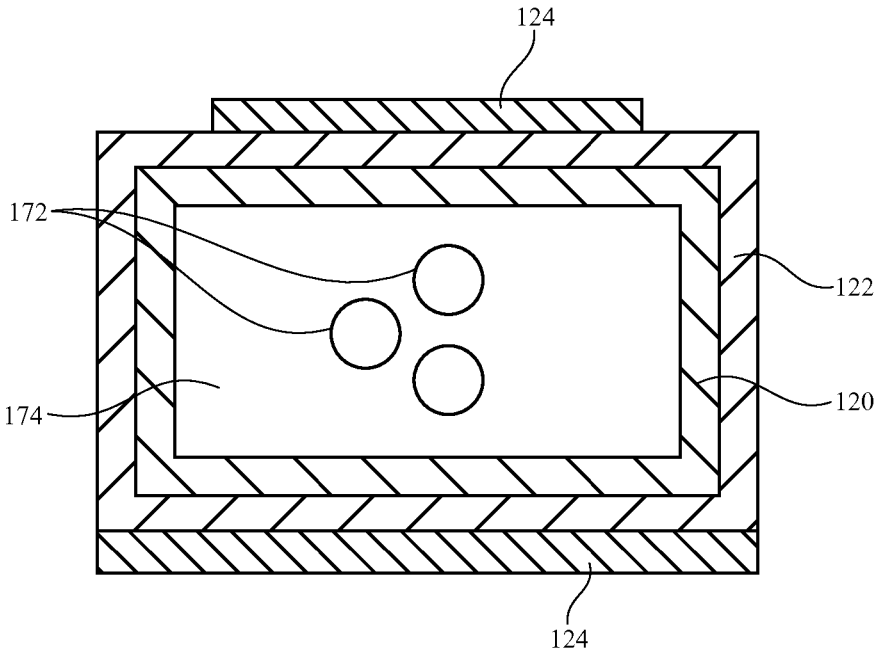
FIG. 17 is a cross-sectional side view of an illustrative hollow antenna structure in accordance with an embodiment.

FIG. 17 is a cross-sectional side view of an illustrative hollow foam structure (hollow foam 120) that has been coated with LDS plastic layer 122 and metal traces 124. As shown in FIG. 17, structures 172 may pass through interior 174 of foam 120. Foam 120 may be a hollow elongated member that extends into the page (in the orientation of FIG. 17). Structures 172 may be electrical components, signal cables, or other elongated structures that extend along the length of foam 120 within elongated interior cavity 174. A foam structure of the type shown in FIG. 17 may, if desired, be used in forming a rectangular display chassis, housing frame, or other elongated member in device 10 (see, e.g., the rectangular structure of FIG. 16).

Figure 18:
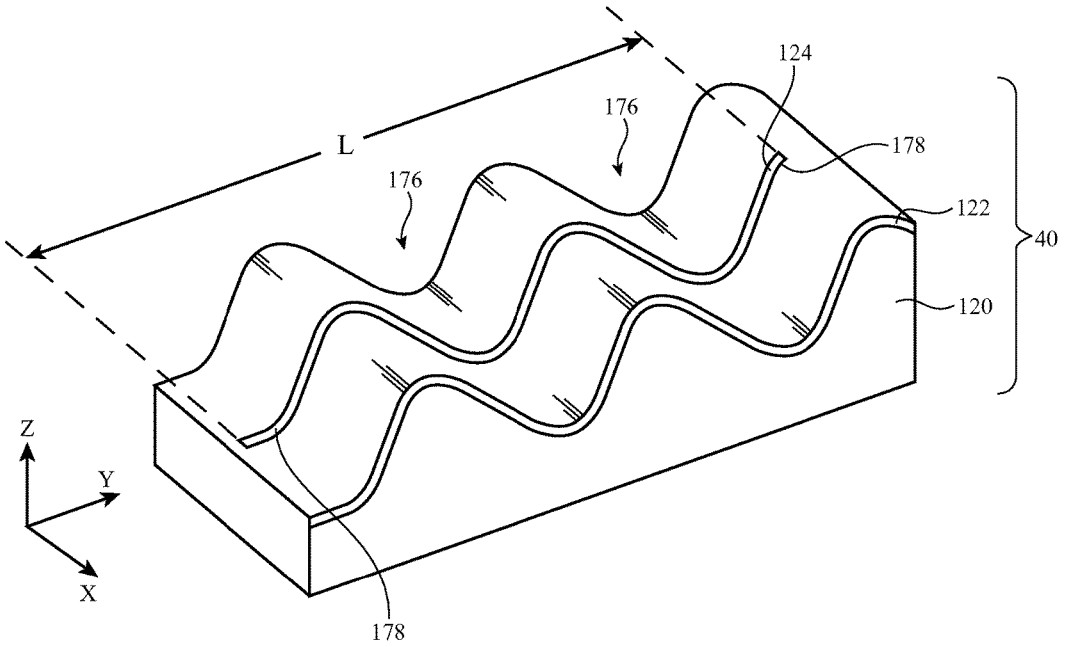
FIG. 18 is a perspective view of an illustrative molded foam structure for an antenna having grooves that form undulations and metal antenna traces that run perpendicular to the grooves in accordance with an embodiment.

FIG. 18 is a perspective view of an illustrative carrier formed from molded foam and LDS plastic layer 122 that has a series of recesses (grooves) such as recesses 176. The presence of recesses 176 may help lengthen antenna trace 124 on the surface of plastic layer 122 without lengthening the distance L along axis Y between ends 178 of antenna trace 124. By causing antenna trace 124 to undulate up and down in vertical dimension Z, the three-dimensional arrangement for antenna 40 of FIG. 18 extends the length of trace 124 without increasing the footprint of foam 120 and thereby allows antenna 40 to be formed with a more compact layout than would otherwise be possible.

The foregoing is merely illustrative and various modifications can be made by those skilled in the art without departing from the scope and spirit of the described embodiments. The foregoing embodiments may be implemented individually or in any combination.

What is claimed is:

1. An antenna, comprising:

a foam member;

a layer of plastic attached to the foam member, wherein the layer of plastic includes a light-sensitive additive;

a metal trace on a laser-activated area of the layer of plastic, wherein the laser-activated area includes a light-activated portion of the light-sensitive additive; and a transmission line that includes a signal path and a portion of the foam member that surrounds the signal path.

2. The antenna defined in claim 1 wherein the layer of plastic is laminated to the foam member without adhesive.

3. The antenna defined in claim 2 wherein the layer of plastic has a thickness of less than 0.5 mm.

4. The antenna defined in claim 1 wherein the foam member comprises a closed cell acrylic foam.

5. The antenna defined in claim 4 wherein the foam member has a dielectric constant of less than 1.25.

6. The antenna defined in claim 5 wherein the metal trace includes a resonating element and an antenna ground.

7. The antenna defined in claim 6 wherein the resonating element is formed on a first surface of the foam member and the antenna ground is formed on a second surface of the foam member.

8. The antenna defined in claim 7 wherein the first and second surfaces of the foam member are planar surfaces.

9. The antenna defined in claim 1 wherein the foam member is a hollow foam member.

10. The antenna defined in claim 1 wherein a portion of the foam member is uncovered by the plastic layer.

11. The antenna defined in claim 10 wherein the foam member has a plurality of recesses and wherein the metal trace extends over the recesses.

12. The antenna defined in claim 1 wherein the foam member has at least one curved surface.

13. The antenna defined in claim 1 wherein the layer of plastic directly contacts the foam member.

14. An electronic device, comprising:

radio-frequency transceiver circuitry;

an antenna formed from an electroplated metal trace on a laser-activated area on a plastic layer that is attached to a planar surface of a foam member without adhesive and molded to a shape of the foam member along at least the planar surface and an additional surface of the foam member adjacent to the planar surface, wherein the laser-activated area on the plastic layer is sensitized for formation of the electroplated metal trace on the laser-activated area; and a transmission line coupled between the radio-frequency transceiver circuitry and the antenna.

15. The electronic device defined in claim 14 wherein the foam member has a first portion that serves as a support for the antenna and has a second portion that extends from the first portion and forms part of the transmission line.

16. The electronic device defined in claim 15 wherein the transmission line includes an inner conductor that is surrounded by the second portion of the foam member.

17. The electronic device defined in claim 14 further comprising solder that attaches a metal structure in the transmission line to the electroplated metal trace.

18. The electronic device defined in claim 14 wherein the additional surface comprises an additional planar surface and the planar surface is perpendicular to the additional planar surface.

19. The electronic device defined in claim 14 wherein the planar surface is a first surface of the foam member, the additional surface is a second surface of the foam member, the foam member includes a third surface, the first and second surfaces are non-coplanar, the first and third surfaces are non-coplanar, and the plastic layer molded to the shape of the foam member along the first, second, and third surfaces of the foam member.

20. An electronic device, comprising:

radio-frequency transceiver circuitry;

an antenna formed from an electroplated metal trace on a laser-activated area on a plastic layer that is attached to a foam member without adhesive; and a transmission line coupled between the radio-frequency transceiver circuitry and the antenna, wherein the foam member has a first portion that serves as a support for the antenna and has a second portion that extends from the first portion and forms part of the transmission line and wherein the transmission line includes an inner conductor that is surrounded by the second portion of the foam member.

* * * * *